US010681443B1

(12) United States Patent
Castillo

(10) Patent No.: US 10,681,443 B1
(45) Date of Patent: Jun. 9, 2020

(54) MAGNETIC CONNECTION FOR LOUDSPEAKER, A LOUDSPEAKER HAVING THE SAME, AND A METHOD OF MANUFACTURE

(71) Applicant: TYMPHANY ACOUSTIC TECHNOLOGY (HUIZHOU) CO., LTD., Guang Dong (CN)

(72) Inventor: Jorge Alejandro López Castillo, Taipei (TW)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/507,367

(22) Filed: Jul. 10, 2019

(51) Int. Cl.

| | |
|---|---|
| ***H04R 1/06*** | (2006.01) |
| ***H04R 9/04*** | (2006.01) |
| ***H04R 9/02*** | (2006.01) |
| ***H04R 9/06*** | (2006.01) |

(52) U.S. Cl.
CPC ..... *H04R 1/06* (2013.01); *H04R 9/025* (2013.01); *H04R 9/04* (2013.01); *H04R 9/06* (2013.01)

(58) Field of Classification Search
CPC . H04R 1/06; H04R 9/025; H04R 9/06; H04R 9/045; H04R 9/046; H04R 9/041
See application file for complete search history.

(56) References Cited

U.S. PATENT DOCUMENTS

2016/0234601 A1* 8/2016 Yuasa ..... G02B 6/0055

* cited by examiner

*Primary Examiner* — Sunita Joshi
(74) *Attorney, Agent, or Firm* — Finnegan, Henderson, Farabow, Garrett & Dunner, LLP

(57) ABSTRACT

A magnetic connection for loudspeaker, a loudspeaker having the same, and a method of manufacture, the loudspeaker including a magnetic motor having an opening extending there through, a voice coil disposed in a gap of the magnetic motor, and a tinsel wire connected to the voice coil and extending through the opening, where the tinsel wire is configured to carry an audio signal to the voice coil.

20 Claims, 4 Drawing Sheets

MAGNETIC CONNECTION FOR LOUDSPEAKER, A LOUDSPEAKER HAVING THE SAME, AND A METHOD OF MANUFACTURE

TECHNICAL FIELD

The present disclosure relates to audio loudspeakers and more particularly to a loudspeaker having a centrally disposed magnetic connection between a voice coil tinsel wire and a speaker wire.

BACKGROUND

Referring to FIG. 1, a traditional loudspeaker consists of a dust-cup 1, a cone 2, a surround 3, a basket 4, a spider 5, a voice coil 6, a coil former 8, a magnet 9, a U-shaped yoke 10, a top-plate 12, and positive and negative tinsel wires 15*a*, 15*b*. Assembly methods for such traditional loudspeakers involve soldering the tinsel wires 15*a*, 15*b* at one end to the voice coil 6 and at the other end to one or more terminals (+, −) that are fixed in the basket 4 in order to provide a reliable and accessible connection point to the loudspeaker wires (not shown) which carry an audio signal to the voice coil 6. This arrangement can lead to various disadvantages.

Firstly, as seen in FIG. 1, the tinsel wires 15*a*, 15*b* are suspended in a limited space above the spider 5 and below the cone body 2. Such an arrangement, within the limited space, should account for an adequate looping or curvature of the tinsel wire 15*a*, 15*b* so that the wires 15*a*, 15*b* do not interfere with any other elements during sound reproduction. If the tinsel wires 15*a*, 15*b* do contact another element, a buzzing noise is typically generated which distorts the acoustic output of the loudspeaker. Such buzzing may lead to malfunctions or to damage of the parts that are contacted. Moreover, an electric short can be produced when, for example, the tinsel wires 15*a*, 15*b* bump into or otherwise contact the electrically conductive basket 4.

A solution for this issue may involve sewing the tinsel wires 15*a*, 15*b* to the spider 5. This would secure the tinsel wires 15*a*, 15*b* within the limited space of the basket 4. However, such a procedure could potentially compromise the elastic properties of the spider 5 and/or the conductivity properties of the tinsel wires 15*a*, 15*b*. The spider 5 may be subjected to remarkable stress which can further complicate this approach.

As mentioned, looping of the tinsel wires 15*a*, 15*b* in traditional loudspeaker assemblies should be done in a manner to avoid physical interference between the tinsel wires 15*a*, 15*b* and other parts during sound reproduction. Also, this looping should avoid sharp folds, bends, or angles within the tinsel wires 15*a*, 15*b* as these can get overstressed during sound reproduction. The tinsel wires 15*a*, 15*b* should be long enough to accompany the coil 6 in its axial movements and should also fit into small cavities, especially in low profile loudspeakers. This presents a significant challenge that could be addressed through shaping of the looping of the wires 15*a*, 15*b* so as to fit within the small cavities but also to avoid sharp folds. However, these intricate arrangements may directly affect the power handling of the loudspeaker if sharp folds are in fact present. The repetitive axial movements of the coil 6 can also stress the tinsel wire 15*a*, 15*b* at different points across its length. Sharp turns and folds are weak points that may suffer the stress in a more significant way leading to damage or malfunction.

Some traditional loudspeaker designs require a pre-assembly process for the tinsel wires 15*a*, 15*b*. These processes may involve soldering the tinsel wires 15*a*, 15*b* to the coil terminals (+, −) and/or attaching the tinsel wires 15*a*, 15*b* to the cone structure using adhesives. This pre-assembly can add complexity and increases the cost of the production of these traditional loudspeakers.

During the assembly of an audio system which includes the traditional loudspeaker arrangement of FIG. 1, an enclosure, and other electronic components, speaker wires are clamped or soldered to the speaker terminals (+, −) for reliable connection. Removing speaker wires deteriorates the terminals (+, −) and makes fixing them a more difficult task. This process is carried out by a human operator and is thus subjected to errors and mistakes.

A loudspeaker arrangement is needed with a new connection arrangement between the voice coil and the loudspeaker wires that carry the audio signal, where the connection may offer increased reliability, effectiveness, and resistance to stress during use. The connection arrangement between the voice coil and the loudspeaker wires that carry the audio signal should also be appropriate for small and low profile speakers, should be simple to assemble, and also easy to maintain.

BRIEF SUMMARY

A loudspeaker is disclosed herein as including a magnetic motor having an opening extending there through, a voice coil disposed in a gap of the magnetic motor, and a tinsel wire connected to the voice coil and extending through the opening, where the tinsel wire is configured to carry an audio signal to the voice coil.

Also described herein is a loudspeaker connection for a loudspeaker having a magnetic motor configured to drive a voice coil, the connection including a terminal disposed in a central opening of the magnetic motor, a tinsel wire extending from the voice coil to the terminal, and a connector disposed in the central opening opposite from the terminal, where the connector is releasably attached to the terminal, where the tinsel wire, the terminal, and the connector define an electrical connection when the connector and the terminal are said releasably attached, and where the electrical connection is configured to carry an audio signal to the voice coil.

The disclosure further provides a method of assembling a loudspeaker having a magnetic motor configured to drive a voice coil. The method includes disposing a terminal in a central opening of the magnetic motor, extending a tinsel wire from the voice coil to the terminal, disposing a connector in the central opening opposite from the terminal, releasably attaching the connector to the terminal with a magnetic force, and establishing an electrical connection between the tinsel wire, the terminal, and the connector to carry an audio signal to the voice coil.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
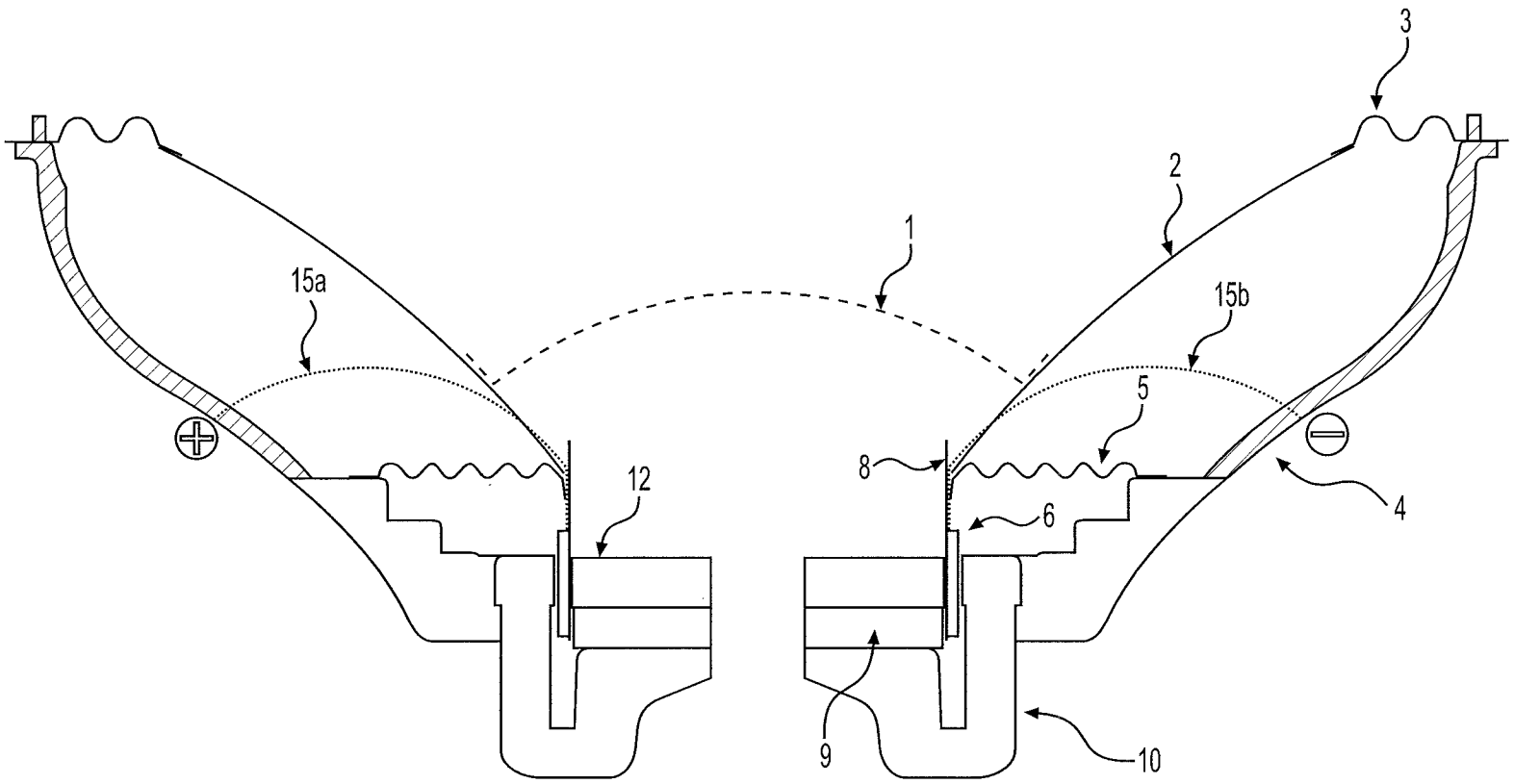
FIG. 1 (PRIOR ART)
FIG. 1 is a cross-sectional view of a traditional loudspeaker assembly.
Figure 2:
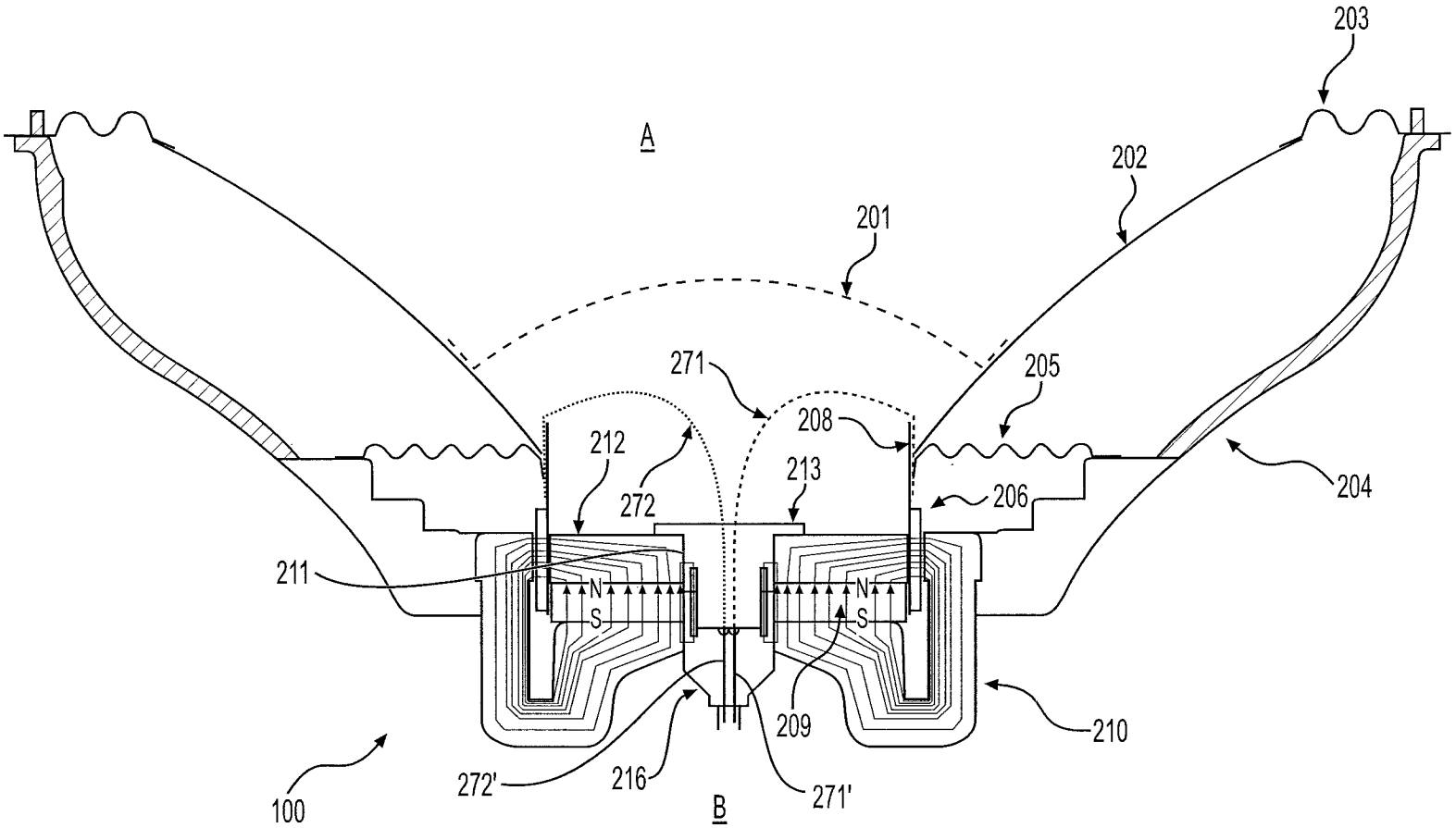
FIG. 2 is a cross-sectional view of a loudspeaker assembly according to exemplary embodiments of the disclosure.

A new loudspeaker assembly having an innovative loudspeaker wire connector together with an alternative loudspeaker terminal is disclosed herein to potentially address one or more of the above discussed challenges associated with traditional designs. FIG. 2 illustrates an exemplary non-limiting embodiment of a loudspeaker 100 with this alternative connection arrangement. The loudspeaker 100 comprises a dust-cup 201 extending across a cone 202 which is affixed to a basket 204 by a surround 203. Beneath the cone 202, a spider 205 connects a voice coil 206 to the basket 204. The voice coil 206 is arranged on a voice coil former 208 which is disposed in a gap of a magnetic motor that that is formed by a top plate 212 disposed upon a magnet 209 which is disposed upon a U-shaped yoke 210. In this example, the magnetic motor is annular in shape and includes an opening 211 extending there through from a front side A of the loudspeaker 100 to a rear side B. As shown, tinsel wires 271, 272 connect the voice coil 206 to a speaker wire connector 216. The tinsel wires 271, 272 extend through the opening 211 to the speaker wire connector 216. The speaker wire connector 216 is further connected to an audio signal generator (not shown) which is configured to generate and deliver audio signals to the voice coil 206 through the speaker connector 216 and tinsel wires 271, 272.

The tinsel wires 271, 722 depart from or lead away from the voice coil 206, but instead of heading to a terminal located in the basket 20'4 (as in traditional loudspeaker arrangements), they loop inwards, towards the inside of the voice coil former 208 where, in the illustrated example, they meet a terminal 213 disposed in the opening 211 of the top plate 212. The tinsel wires 271, 272 may be attached to the terminal 213 by any suitable method which may involve, for example, the use of solder, adhesives, and/or screws, etc. The terminal 213 is attached to the top-plate 212 and it extends along the opening 211 to a certain length. The tinsel wires 271, 272 may be attached to the terminal 213 at a top portion for accessibility purposes. Here, the tinsel wires 271, 272 are connected to built-in wires 71', 72' disposed within the terminal 213 which effectively extend the tinsel wires to a bottom of the terminal 213. The speaker wire connector 216 may be connected to and mated with the terminal 213. In the illustrated embodiment, the speaker wire connector 216 may be magnetically attracted to the terminal 213 by the effect of the speaker motor 209, 210, 212. The terminal 213 and the connector 216 fit into each other so that the electric circuits are connected. For example, on a side facing the rear B of the loudspeaker, the terminal 213 may include a male connection feature. Correspondingly, on a side facing the front A of the loudspeaker, the speaker wire connector 216 may include a female connection feature. The female connection portion is configured to receive and retain the male connection portion when the terminal 213 and connector 216 are mated. This configuration also serves to align the built-in wires 271', 272' of the terminal with corresponding wires in the connector 216 to ensure the integrity of the electrical connection. For this purpose, the female and/or male connection portions may be keyed or have some other type of alignment mechanism to ensure proper connection.

Of course, this description is exemplary. The terminal 213 may include the female connection portion and the connector 216 may include the male connection portion. Alternatively, the terminal 213 and the connector 216 may include any other suitable attachment mechanism to facilitate the releasable attachment thereof.

Above, the terminal 213 is described as having built-in wires 271', 272' which connect at one end with the tinsel wires 271, 272, respectively, and at the other end with the corresponding speaker wires. In another embodiment, these built-in wires 271', 272' may be omitted and the tinsel wires 271, 272 may extend through the terminal 213 directly to the interface with the speaker wires.

Figure 3:
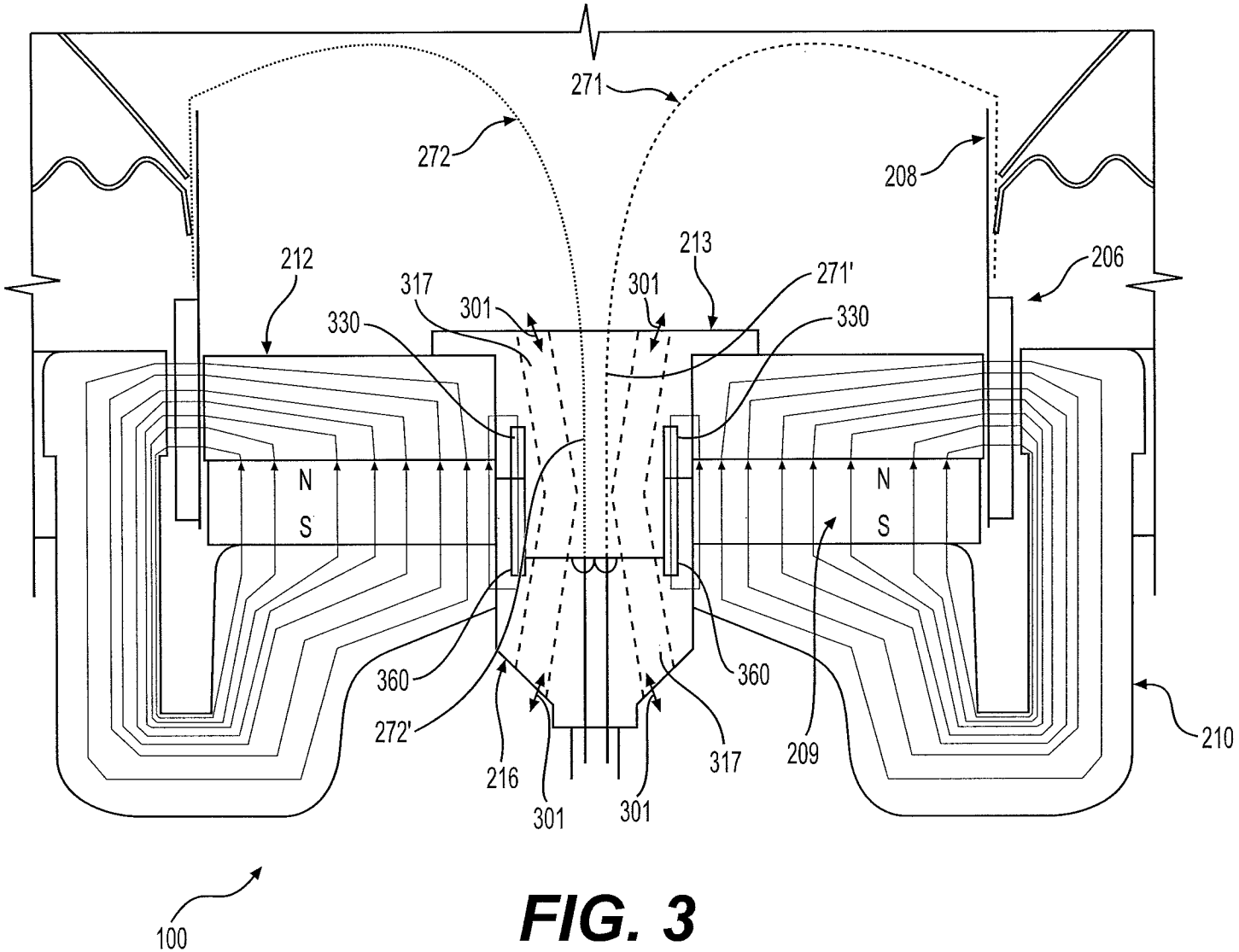
FIG. 3 is an enlarged partial view of the cross-sectional view of FIG. 2.

FIG. 3 shows an enlarged partial view of the loudspeaker 100 of FIG. 2. More specifically the connection between the terminal 213 and the speaker wire connector 216 is illustrated. Magnetic paths generated by the magnetic motor 209, 210, 212 are depicted by arrowed lines 301. In order to take advantage of the magnetic force provided by the motor 209, 210, 212 and use part of it to achieve the connection between terminal 213 and wire connector 216, both parts 213 and 216 may include metallic components 330 and 360, respectively, that may create a secondary magnetic path. These metallic components 330, 360 may be made of a magnetically conductive material such as steel or iron. The strength of the magnetic field occurring at the secondary magnetic path depends on the geometry, material and position of these metallic components 330, 360. The magnetic strength of the secondary magnetic path will determine the strength of the connection between the terminal 213 and the connector 216. It is desirable that this connection is sufficiently strong to provide a reliable connection but at the same time should minimize the loss of efficiency of the magnetic structure at the magnetic gap where the voice coil 206 sits. In FIG. 3, these metallic components are depicted as a metallic ring 330 disposed in the terminal 213 and another metallic ring 360 disposed in the connector 216. Both the terminal 213 and the connector 216 may have such metallic rings. However, in an alternate embodiment, only the connector 216 includes the metallic component 360 needed to magnetically attract and correctly couple the terminal 213 and thus close the electric circuit. Also in FIG. 3, several air passages 317 are shown extending through the terminal 213 and the connector 216. The air passages 317 are arranged to allow air circulation during sound reproduction between the air cavity within the speaker structure and the air region outside the loudspeaker for cooling purposes. This air circulation is represented in the drawing by two-headed arrows.

Figure 4:
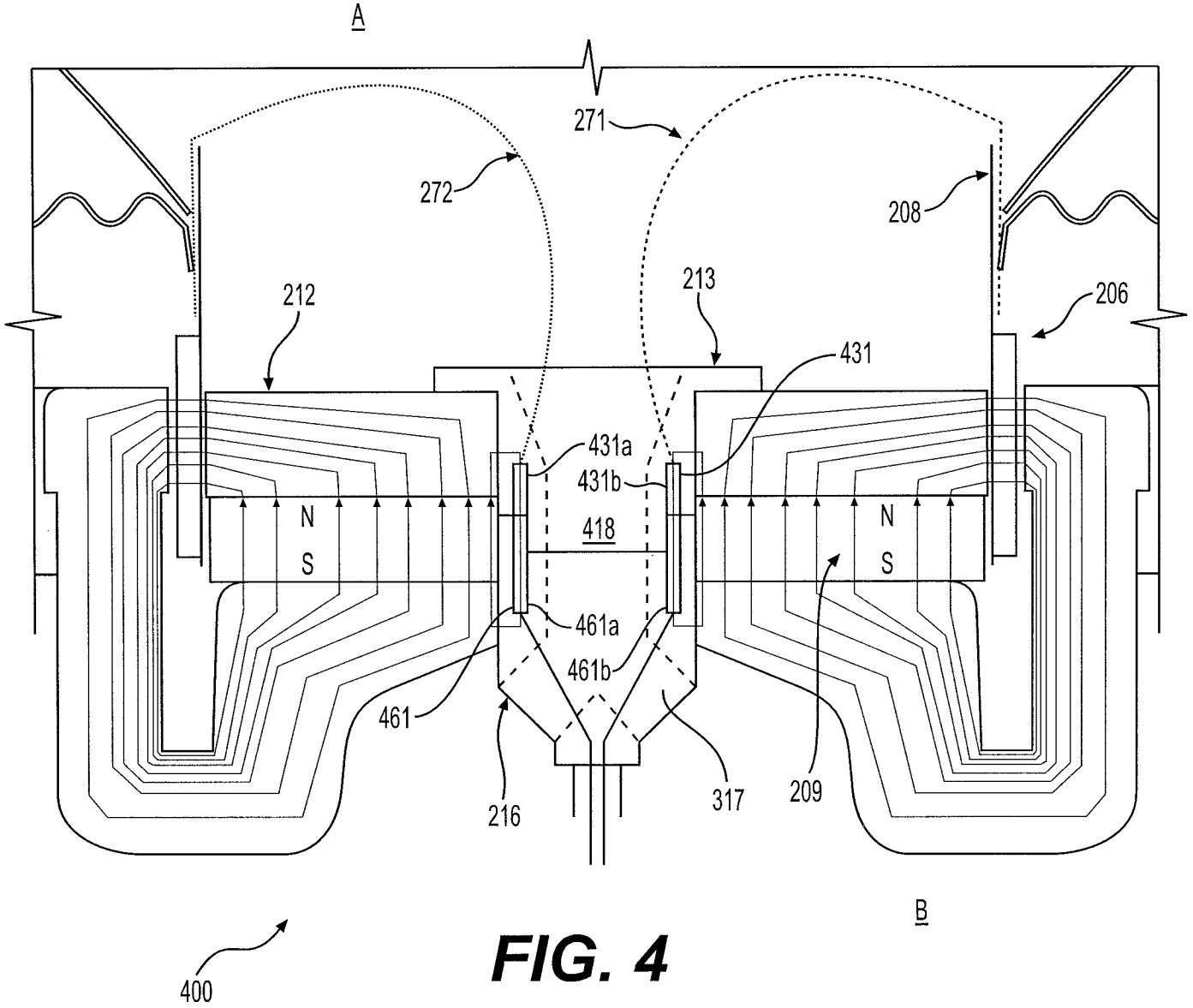
FIG. 4 is a cross-sectional view of a loudspeaker assembly according to exemplary embodiments of the disclosure.

FIG. 4 shows an enlarged partial cross-sectional view of a loudspeaker 200 according to exemplary disclosed embodiments. In the drawing, features consistent with those discussed with regard to the loudspeaker 100 are indicated with consistent reference numerals and, for purposes of brevity, are not specifically reintroduced nor discussed in detail. In the loudspeaker 200, the terminal 213 includes a metallic ring 431 which is composed of two separate ring pieces 431*a* and 431*b*. Similarly, the speaker wire connector 216 includes a metallic ring 461 composed of two ring pieces 461*a* and 461*b*. In this configuration, the metallic rings 431, 461 are not only used as a part of the secondary magnetic path that attracts the connector 216 to the terminal 213 but also as wires that electrically connect the terminal 213 to the connector 216. That is, the tinsel wires 271, 272 connect respectively to the ring pieces 431*b*, 431*a* which connect respectively with the ring pieces 461*b*, 461*a*, which in turn connect to the speaker wires and ultimately to the audio signal generator. In this case metallic rings 431, 461 may be split into two different pieces each, 431*a*, 431*b* and 461*a*, 461*b*, since positive and negative wires are required to be arranged separately to successfully connect the loudspeaker to the electric sound source. In addition, the terminal 213 and the connector 216 include an air passage 418 that traverses through both of these elements from the front side A of the loudspeaker 200 to the rear side B in order to promote air circulation and ventilation for cooling purposes.

The metallic rings 431, 461 and the ring pieces 431*a*, 431*b*, 461*a*, 461*b* are described herein by way of example only. In alternate embodiments, the terminal 213 and/or the connector 216 of the loudspeakers 100, 200 may include none, one, or a plurality of any suitable magnetic components taking any suitable shape and form such as a ring, a rod, a wire, a sphere, a disk, a plate, etc.

The aforementioned embodiments show an alternative loudspeaker wire connection that does not need additional materials or processes like soldering, the use of adhesives nor screws, to connect the voice coil wires to the loudspeaker wires. Also, the connector can be attached and detached easily improving the convenience of this connection, reducing the time and minimizing the damage caused by an operator's mistakes. Inner looping of the tinsel wires as disclosed herein may be less likely to interfere with movable components of the loudspeaker and it can be adapted to low profile loudspeakers without the necessity of sharp folds. In short, the disclosed loudspeaker arrangement provides a connection between the voice coil and the loudspeaker wires that is reliable, effective, resistant to stress during use, appropriate for small and low profile speakers, simple to assemble, and easy to maintain.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A loudspeaker, comprising:

a magnetic motor having an opening extending there through;

a voice coil disposed in a gap of the magnetic motor;

a tinsel wire connected to the voice coil and extending through the opening;

a connector disposed within the opening opposite from the terminal; and a terminal disposed in the opening;

wherein the tinsel wire is configured to carry an audio signal to the voice coil; and wherein the tinsel wire, the terminal, and the connector comprise a releasable attachment arrangement configured to releasably attach the terminal to the connector for defining an electrical connection when the connector and the terminal are said releasably attached.

2. The loudspeaker of claim 1, wherein the terminal is affixed to a top plate of the magnetic motor, wherein the tinsel wire is electrically connected to a built-in wire disposed within the terminal.

3. The loudspeaker of claim 2, further comprising a speaker wire disposed within the connector, wherein the releasable attachment arrangement is configured to releasably attach the terminal to the connector and to dispose the built-in wire in the electrical connection with the speaker wire when the terminal and the connector are said releasably attached.

4. The loudspeaker of claim 3, wherein the tinsel wire includes a first tinsel wire and a second tinsel wire, wherein the built-in wire comprises a first built-in wire and a second built-in wire, wherein the speaker wire comprises a first speaker wire and a second speaker wire, wherein the first tinsel wire is connected to the first built-in wire and the second tinsel wire is connected to the second built-in wire, and wherein the first and second built-in wires are connected to the first and second speaker wires, respectively, when the terminal and the connector are said releasably attached.

5. The loudspeaker of claim 3, wherein the terminal and the connector are said releasably attached by at least one of a friction fit and a magnetic force.

6. The loudspeaker of claim 5, wherein the magnetic force is generated by the magnetic motor, wherein the terminal includes a terminal magnetic component and the connector includes a connector magnetic component, wherein the terminal magnetic component and the connector magnetic component create a magnetic path that attracts the terminal and the connector.

7. The loudspeaker of claim 6, wherein the terminal magnetic component is a terminal metallic ring and the connector magnetic component is a connector metallic ring.

8. The loudspeaker of claim 7, wherein the terminal metallic ring comprises a first terminal ring portion and a second terminal ring portion spatially separated from the first terminal ring portion, wherein the connector metallic ring comprises a first connector ring portion and a second connector ring portion spatially separated from the first connector ring portion.

9. The loudspeaker of claim 8, wherein the first built-in wire is connected to the first terminal ring portion, wherein the second built-in wire is connected to the second terminal ring portion, wherein the first connector ring portion is connected to the first speaker wire, wherein the second connector ring portion is connected to the second speaker wire, and wherein the first and second terminal ring portions are arranged to electrically connect with the first and second connector ring portions, respectively, when the terminal and the connector are said releasably attached.

10. The loudspeaker of claim 3, wherein the terminal and the connector include air passages that are disposed in communication when the terminal and the connector are said releasably attached to allow airflow there through.

11. A loudspeaker connection for a loudspeaker having a magnetic motor configured to drive a voice coil, the connection comprising:

a terminal disposed in a central opening of the magnetic motor;

a tinsel wire extending from the voice coil to the terminal; and a connector disposed in the central opening opposite from the terminal;

wherein the connector is releasably attached to the terminal;

wherein the tinsel wire, the terminal, and the connector define an electrical connection when the connector and the terminal are said releasably attached; and wherein the electrical connection is configured to carry an audio signal to the voice coil.

12. The loudspeaker connection of claim 11, wherein the terminal and the connector are said releasably attached by a magnetic force generated by the magnetic motor, wherein the terminal includes a terminal metallic ring and the connector includes a connector metallic ring, wherein the terminal metallic ring and the connector metallic ring create a magnetic path that attracts the terminal and the connector.

13. The loudspeaker connection of claim 12, wherein the tinsel wire includes a first tinsel wire and a second tinsel wire, wherein the terminal includes a first built-in wire and a second built-in wire, wherein the connector includes a first speaker wire and a second speaker wire, wherein the first tinsel wire is connected to the first built-in wire and the second tinsel wire is connected to the second built-in wire.

14. The loudspeaker connection of claim 13, wherein the first and second built-in wires are electrically connected to the first and second speaker wires, respectively, when the terminal and the connector are said releasably attached.

15. The loudspeaker connection of claim 13, wherein the terminal metallic ring comprises a first terminal ring portion and a second terminal ring portion spatially separated from the first terminal ring portion, wherein the connector metallic ring comprises a first connector ring portion and a second connector ring portion spatially separated from the first connector ring portion.

16. The loudspeaker connection of claim 15, wherein the first and second built-in wires are connected to the first and second terminal ring portions, respectively, wherein the first and second speaker wires are connected to the first and second connector ring portions, respectively, and wherein the first and second terminal ring portions are electrically connected to the first and second connector ring portions, respectively, when the terminal and the connector are said releasably attached.

17. The loudspeaker connection of claim 11, wherein the terminal and the connector include air passages that are disposed in communication when the terminal and the connector are said releasably attached to allow airflow there through.

18. A method of assembling a loudspeaker having a magnetic motor configured to drive a voice coil, the method comprising:

disposing a terminal in a central opening of the magnetic motor;

extending a tinsel wire from the voice coil to the terminal;

disposing a connector in the central opening opposite from the terminal;

releasably attaching the connector to the terminal with a magnetic force; and establishing an electrical connection between the tinsel wire, the terminal, and the connector to carry an audio signal to the voice coil.

19. The method of claim 18, further comprising:

the magnetic motor providing the magnetic force;

disposing a terminal magnetic component in the terminal;

disposing a connector magnetic component in the connector; and creating a magnetic path between the terminal and connector magnetic components to attract the terminal and connector to provide said releasable attachment.

20. The method of claim 19, wherein said establishing the electrical connection further comprises including the terminal magnetic component and the connector magnetic component in the circuit created by the tinsel wire, the terminal, and the connector.

* * * * *